US005938111A

United States Patent [19]

Grigsby

[11] Patent Number: 5,938,111

[45] Date of Patent: Aug. 17, 1999

[54] CORRUGATED PAPERBOARD CONTAINER WITH LOCKING BOTTOM FLAPS TO SELF-MAINTAIN SQUARED-OPEN CONFIGURATION

[75] Inventor: Charles F. Grigsby, Marietta, Ga.

[73] Assignee: North American Container Corporation, Mableton, Ga.

[21] Appl. No.: 09/034,915

[22] Filed: Mar. 4, 1998

[51] Int. Cl.[6] ..... B65D 5/10

[52] U.S. Cl. ..... 229/155; 229/185; 493/183; 493/453

[58] Field of Search ..... 229/117, 117.03, 229/155, 185; 493/162, 183, 453

[56] References Cited

U.S. PATENT DOCUMENTS

| | | | |
|---|---|---|---|
| 1,779,403 | 10/1930 | Greve | 229/155 |
| 2,361,603 | 10/1944 | Cohen et al. | 229/185 |
| 2,727,675 | 12/1955 | Mairs et al. | 229/155 |
| 3,107,840 | 10/1963 | Vesak | 229/155 |
| 3,381,328 | 5/1968 | Croley et al. . | |
| 4,091,983 | 5/1978 | Booth et al. . | |
| 4,361,267 | 11/1982 | Wozniacki . | |
| 5,522,628 | 6/1996 | Fillis | 229/117 |

*Primary Examiner*—Gary E. Elkins
*Attorney, Agent, or Firm*—Kennedy, Davis & Kennedy

[57] ABSTRACT

A container formed from a blank of corrugated paperboard in which scores define a plurality of wall panels and bottom flaps. Two opposing bottom flaps overlap opposing sides and interlock together in a notch on a distal edge of one of the bottom flaps, whereby the container substantially maintains a squared-open configuration for inverting the container bottom-down on a pallet, with reduced manpower and effort on a production line.

4 Claims, 2 Drawing Sheets

CORRUGATED PAPERBOARD CONTAINER WITH LOCKING BOTTOM FLAPS TO SELF-MAINTAIN SQUARED-OPEN CONFIGURATION

TECHNICAL FIELD

The present invention relates generally to corrugated paperboard containers. More particularly, the present invention relates to corrugated paperboard containers having bottom flaps which lock together to self-maintain the containers in squared-open configurations especially for filing with bulk materials.

BACKGROUND OF THE INVENTION

Containers are used to enclose goods that are transported from manufacturer's to consumers. The containers enclose the goods for protecting the goods, for shipping and handling of the goods, and for storage of the goods.

Corrugated paperboard containers provide a light weight yet relatively strong body for enclosing goods. Corrugated paperboard containers, known generally in the trade as slotted cartons, provide a number of advantages. Slotted cartons typically are formed from an elongate blank of corrugated paperboard sheet. Scores are formed in the blank which are spaced-apart and transverse to a longitudinal axis of the blank. The scores define wall panels in the blank, and typically bottom and top flaps are defined by a pair of scores spaced-apart from the longitudinal axis. The flaps fold along the scores to close the container formed from the blank.

A score at one end of the blank defines a manufacturer's joint. The blank of the corrugated paperboard sheet is folded on the scores. The manufacturer's joint is adhesively joined to the wall panel at the opposite end of the blank. A walled container defining a cavity for holding goods is thereby formed. Such containers can be shipped and stored in a "knocked-down" configuration in which the container is substantially flat. For use, the container is "squared-open" whereby the walls of the container are disposed at substantially perpendicular angles. The walls of the container define a cavity for containing goods within the container. These containers also typically include foldable flaps to form a closed top and bottom for the container. On large containers, often a separate corrugated top cap or lid is preferred for ease of handling, top loading the container, and cost. Such top caps are typically constucted of a lighter weight single-wall corrugated paperboard.

Large knock-down corrugated paperboard containers are used for holding, storing, and shipping bulk flowable materials. For example, plastics manufacturer's ship containers holding hundreds of pounds of plastic beads to customers. Typically such containers are large. One plastics resin manufacturer uses containers which are approximately thirty-six inches wide, forty-two inches long, and thirty-three inches high, which defines a cavity of approximately twenty-eight cubic feet. Because of the size of the container, its weight, and the difficulties in folding the bottom flaps, two production line workers handle and setup the knocked-down containers at the filling station on the production line.

For use, the corrugated paperboard container is squared-open and the bottom is formed by folding the opposing bottom flaps inwardly. Two opposing flaps from two opposing side panels are folded inwardly. The other two opposing flaps are then folded over. The folded-over flaps thereby define the bottom of the container. The squared-open container must then be inverted onto a pallet with the bottom down. The bottom flaps however tend to spring open along the scores separating the bottom flaps from the respective side or end panel of the corrugated paperboard body. The springy bottom flaps make inverting the container awkward and difficult to accomplish. The container may move away from a substantially squared-open configuration to a partially collapsed configuration. To keep the bottom flaps from moving from the folded, bottom-defining, squared-open orientation, a ribbon of adhesive tape is used to hold the flaps closed. The workers attach the tape along the seam between the opposing flaps.

The two workers accordingly are needed in order to hold the container substantially squared open and to apply the tape over the seam between the opposing flaps. The workers than invert the container and position the bottom on a pallet. The pallet and the open container are moved along the assembly line for filling with the bulk materials, such as plastic pellets.

Accordingly, there is a need in the art for an improved corrugated paperboard container that is more readily squared-open and inverted for filling with bulk materials.

SUMMARY OF THE PRESENT INVENTION

The present invention solves the need in the art by providing a corrugated paperboard container that substantially self-maintains a squared-open configuration, whereby the container is readily squared open and inverted for positioning on a pallet for filling during production line processing. More particularly described, the corrugated paperboard container of the present invention is formed by folding a corrugated paperboard blank on a plurality of scores which define a sequence of a first panel, a second panel, a third panel, a fourth panel, and a manufacturer's joint. The manufacturer's joint overlaps a portion of the first panel and is adhered thereto. The panels define side walls of the corrugated paperboard container body.

Each one of the panels has at least a bottom flap foldably connected thereto along a respective score line. The bottom flaps of at least the second panel and the fourth panel at least partially overlap when the bottom flaps are folded on the respective scores to define a bottom for said corrugated paperboard container body.

The bottom flap of the second panel defines a notch in a distal edge intermediate the sides of the bottom flap defined by cuts that separate the bottom flap of the second panel from the bottom flap of the first and third panels.

An obliquely oriented score in the bottom flap on the fourth panel defines a wedge-shaped portion that folds outwardly along the score. The score extends from a side edge at an oblique angle to an intersection in a distal edge. The intersection of the score and the distal edge aligns with the notch in the bottom flap of the second panel.

The bottom of the corrugated paperboard container body is formed by folding the bottom flaps one over the next in a sequence of the first panel, the second panel, the third panel, and the fourth panel. The distal edge portion of the bottom flap of the fourth panel engages the notch in the distal edge of the bottom flap of the second panel. This is accomplished by foldingly moving the wedge-shaped portion on the score in a first direction outwardly and by pulling a side portion of the second bottom flap outwardly until the distal edge of the fourth bottom flap engages the notch in the second bottom flap. The wedge-shaped portion is then moved in a second opposite direction past the bottom flap of the second panel, so that at least a portion of the wedge-shaped portion is covered by a portion of the bottom flap of the second panel.

In another aspect, the present invention provides a method of forming a bottom in a corrugated paperboard container substantially self-maintains a squared-open configuration for inverting and positioning the container on a pallet for filling. The method comprises the steps of (a) squaring-open a corrugated paperboard body formed by folding a corrugated paperboard sheet on a plurality of scores which define therein a sequence of a first panel, a second panel, a third panel, a fourth panel, and a manufacturer's joint. The manufacturer's joint overlapping a portion of the first panel and is adhered thereto, so that the first panel, the second panel, the third panel, and the fourth panel defining side walls of the corrugated paperboard body. The bottom of the container body is then formed by (b) folding in sequence a first bottom flap, a second bottom flap, a third bottom flap, and a fourth bottom flap, one on top of another. The bottom flaps foldably connect along scores to a respective one of the first panel, the second panel, the third panel, and the fourth panel. The second and fourth bottom flaps at least partially overlap at distal edge portions.

The bottom flaps interlock together by (c) engaging a distal edge of the fourth bottom flap in a notch in a distal edge of the second bottom flap. The notch is intermediate the side edges defined by the pair of cuts that separate the second bottom flap from the first and third bottom flaps. The bottom flaps engage by folding a wedge-shaped portion of the bottom flap of the fourth panel on a score in a first direction and moving the second bottom flap also in the first direction past the edge of the forth bottom flap. The distal edge engages the notch. The wedge-shaped portion is defined by a score extending at an oblique angle relative to the distal edge from a side edge to the distal edge intermediate the side edge and a cut separating the fourth bottom flap from the third bottom flap. The wedge-shaped portion is then insertingly moved in a second opposite direction so that a portion of the fourth bottom flap is disposed between the second bottom flap and the first bottom flap. The wedge-shaped portion of the fourth bottom flap is at least partially overlapped by a portion of the second bottom flap. The resulting bottom, with the fourth bottom flap interlocked in the notch with the second bottom flap, holds the corrugated paperboard body in a substantially squared-open configuration so that the container body can be inverted to a bottom-down orientation on a pallet for filling.

Objects, features, and advantages of the present invention will become apparent from a reading of the following detailed description of the invention and claims in view of the appended drawings.

DETAILED DESCRIPTION OF THE PREFERRED EMBODIMENTS

Figure 1:
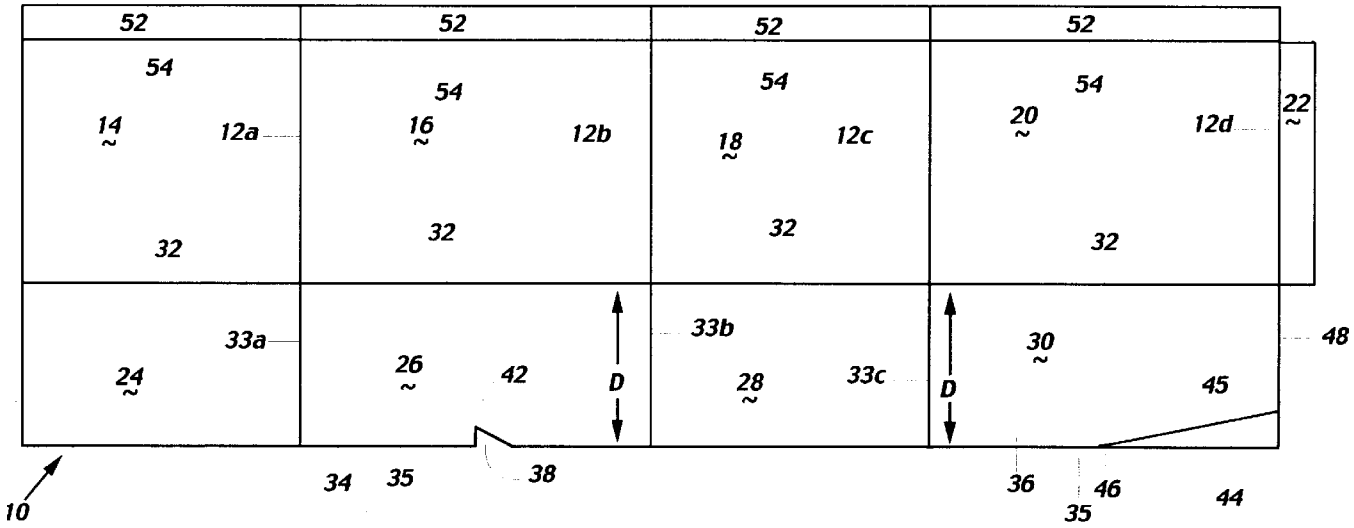
FIG. 1 is a plan view of a corrugated paperboard sheet for forming a container having lockable bottom flaps for substantially self-maintaining a squared-open configuration according to the present invention.

Referring now in more detail to the drawings in which like numerals indicate like parts throughout the several views, FIG. 1 illustrates a plan view of a corrugated paperboard sheet 10 for forming a corrugated paperboard container with lockable bottom flaps according to the present invention. The blank 10 includes a plurality of scores 12 which are spaced-apart and transverse to longitudinal axis 11 in the corrugated paperboard sheet. The direction of the corrugations is preferably transverse to the longitudinal axis 11. The scores 12*a*, 12*b*, 12*c*, and 12*d* define a sequence of a first panel 14, a second panel 16, a third panel 18, a fourth panel 20, and a manufacturer's joint 22, in the blank 10. The manufacturer's joint 22 conventionally overlaps a portion of the first panel 14 when the blank 10 is folded on the scores 12 to define the body of a corrugated paperboard container. The manufacturer's joint 22 conventionally adheres to the first panel 14 with adhesive, to define the body of the container. The first panel 14, the second panel 16, the third panel 18, and the fourth panel 20 thereby define walls of the corrugated paperboard body.

The blank 10 also defines a plurality of bottom flaps 24, 26, 28 and 30 which foldably attach along respective score lines 32 to the first panel 14, the second panel 16, the third panel 18, and the fourth panel 20. The bottom flaps are separated by conventional cuts 33 in the blank 10 along the respective scores 12. The length D between the score 32 and a distal edge 35 of at least the second and the fourth bottom flaps 26, 30 is such that the bottom flaps 26, 30 at least partially overlap distal edge portions generally 34, 36 when the bottom flaps are folded on the scores 32 in order to define a bottom for the corrugated paperboard body, as discussed below.

The bottom flap 26 extending from the second panel 16 defines a notch 38 in the distal edge 35 intermediate the sides of the bottom flap defined by the cuts 33*a* and 33*b*. In the illustrated embodiment, the notch 38 is preferably medial the sides defined by the cuts. The notch 38 preferably defines a radius at the apex 42.

An oblique score 45 in the bottom flap 30 defines a wedge-shaped portion 44 near the distal edge 35. The score 45 extends from a side edge 48 of the bottom flap 30 to an intersection with the distal edge 35 intermediate the cut 33*c* and the side edge 48. The score 45 preferably intersects the distal edge 50 for aligning with the notch 38 in the bottom flap 26 of the second panel 16, for a purpose discussed below.

FIG. 1 also illustrates top flaps 52 foldably joined by scores 54 to the first panel 14, the second panel 16, the third panel 18, and the fourth panel 20. The score 54 is parallel to the longitudinal axis 11 of the blank 10. The top flaps 52 can fold on the scores 54 and attach with adhesive to outer surfaces of the panels 14–20, or define a top closure for the container. In an alternate embodiment (not illustrated) the blank 10 does not include the top flaps 52, but utilizes a top cap or lid for closure.

Figure 2:
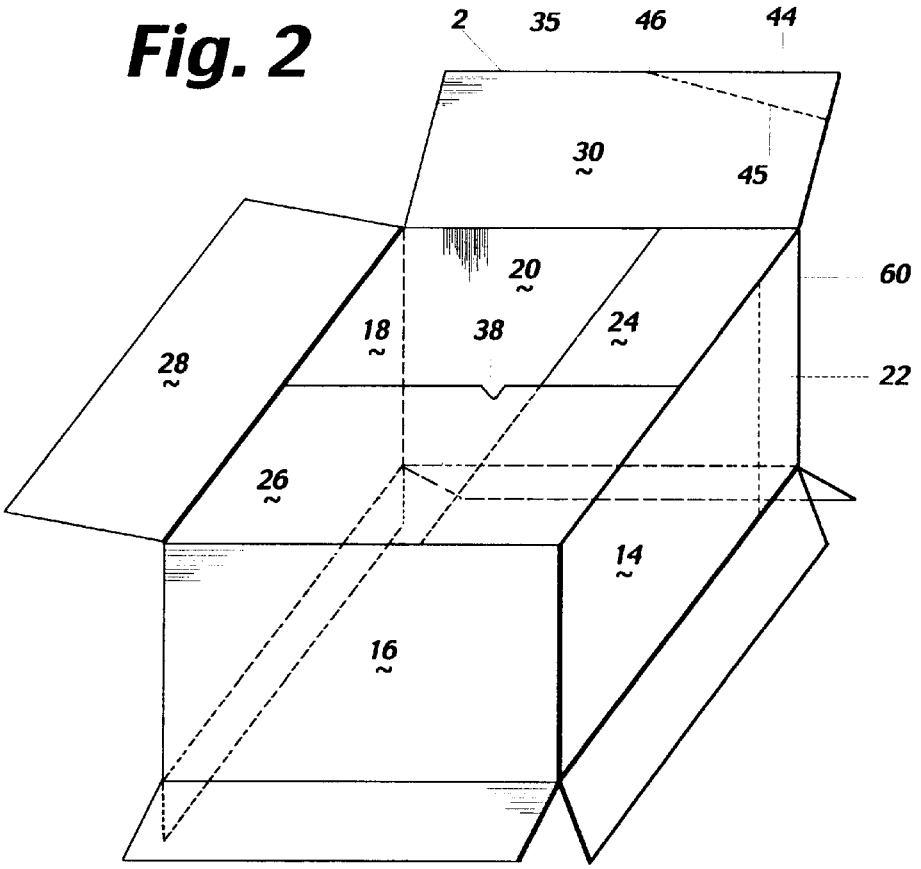
FIG. 2 is a perspective view of a squared-open container body formed from the blank illustrated in FIG. 1.
Figure 3:
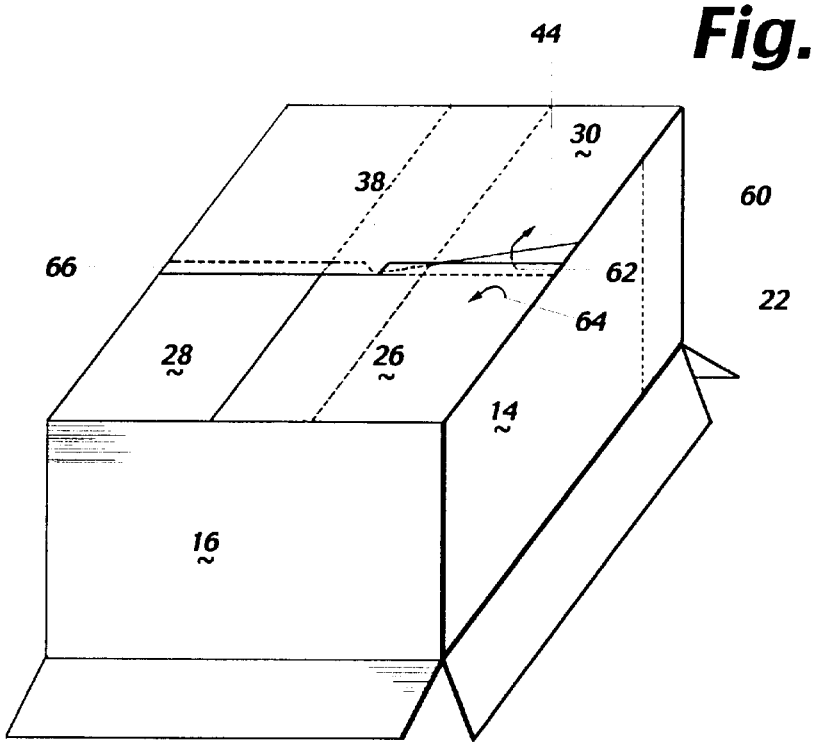
FIG. 3 is a perspective view of the container shown in FIG. 2, with the bottom flaps folded over sequentially to define a bottom for the container.

FIGS. 2 and 3 provide perspective views of a squared-open container body 60 inverted to a bottom-up orientation. The body 60 results from folding the blank 10 illustrated in FIG. 1 on the scores 12. The manufacturer's joint 32 attaches with adhesive to the first wall 14. The bottom of the container body 60 is then formed by folding the bottom flaps 24, 26, 28, and 30 on the scores 32. In the invention, the bottom flaps 24, 26, 28, and 30, fold in a sequence of the first bottom flap 24, the second bottom flap 26, the third bottom 28, and the fourth bottom flap 30, one on top of the other. Finally, the opposing bottom flaps 26 and 30 interlock together in overlapping relation to hold the bottom closed and the container 60 substantially squared-open while the container is reversed and oriented with the bottom placed on a pallet for filling.

Figure 4:
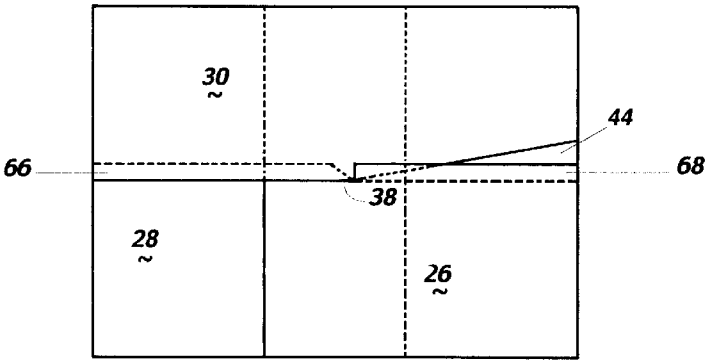
FIG. 4 is a bottom plan view of the container shown in FIG. 3, illustrating the sequentially folded bottom flaps overlapping and locked together so that the container remains substantially square for being inverted onto a pallet.

FIG. 4 is a bottom plan view of the container 60 shown in FIG. 3, illustrating the sequentially folded bottom flaps 24, 26, 28, 30, overlapping and locked together at the notch 38 and the intersection 46 so that the container remains substantially squared-open while being inverted onto a pallet.

The operation of interlocking the opposing bottom flaps 26 and 30 is discussed below with reference to FIGS. 3 and 4. The bottom flap 30 folds over along the score 32. The distal edge portion 36 of the bottom flap 30 overlaps the distal edge portion 34 of the opposing bottom flap 26. The wedge portion 44 of the bottom flap 30 is grasped and folds along the score 45 moving in a first direction 62 outwardly away from the bottom and the container 60. As the wedge portion 44 moves outwardly, a portion of the opposing bottom flap 26 aligned therewith is grasped and also moves outwardly 64 away from the container. The wedge portion moves upwardly and the bottom flap 26 moves outwardly past the distal edge 35 of the bottom flap 30. The intersection 46 in the distal edge 35 of the bottom flap 30 enters the notch 38 in the bottom flap 26. The wedge portion 44 then is moved back, and tuckingly inserts between the outwardly opposing bottom flap 26 and the inwardly bottom flap 24. The opposing panels 26 and 30 are thereby interlocked together. As illustrated in FIG. 4, a side portion 66 of the bottom flap 30 overlaps a portion of the bottom flap 26 from the side to the notch 38. The distal edge 35 of the bottom flap 30 engages the notch 38. A portion 68 of the bottom flap 26 overlaps a portion of the bottom flap 30 from the notch 38 to the side 48. The resulting bottom of the container body 60 interlocks together sufficiently to hold the container 60 in a substantially squared-open position so that the container can be inverted to a bottom-down position on a pallet.

In one embodiment, the corrugated paperboard blank 10 is BC D/W flute, 600 pound test board. The wall panels 14, 16, 18, and 20 have lengths of 33½ inches measured between the scores 32 and 54. The wall panel 14 has a length of 35 and ⅞ inches measured from a side edge of the blank 10 to the score 12*a*. The wall panel 16 has a length of 42 and ¼ inches measured from the score 12*a* to the score 12*b*. The wall panel 18 has a length of 35 and ½ inches measured from the score 12*b* to the score 12*c*. The wall panel 20 has a length of 42 and ⅜ inches measured from the score 12*c* to the score 12*d*. The resulting corrugated paperboard container has inner dimensions of 41 inches long by 35 and ¼ inches wide by 33 inches tall, with tolerances of _ ⅛ inch.

The bottom flaps 24, 26, 28, and 30 are slightly shorter in length due the cuts 33 on the score lines 12*a*, 12*b*, and 12*c*, to separate the bottom flaps from each other. In this embodiment, the bottom flaps 24, 26, 28, and 30 have lengths D of 19 and ⅜ inches measured between the scores 32 and the distal edges 35 of the bottom flaps.

The notch 38 in the bottom flap 26 is 19 and ⅛ inches from the edge defined by the cut 33*a*. The notch 38 defines a 4 and ¼ inch cut-out in the distal edge of the bottom flap 24. The apex 42 of the notch 38 is preferably defined by a ⅜ inch radius. The score 45 defining the wedge portion 44 is on a line starting at the side edge 48 inwardly 6 and ¾ inches from the distal edge 35 of the bottom flap. The line intersects the distal edge 35 at a point 23 and ¾ inches from the side edge 48.

In an alternate embodiment, the side walls of the container 60 are strengthened by positioning within the cavity of the container a corrugated paperboard sleeve. Such sleeve is conventionally formed of a corrugated paperboard blank, such as the blank 10 shown in FIG. 1, without the bottom flaps 24, 26, 28, and 30, and without the top flaps 52. Such sleeve may be laminated to the corrugated paperboard sheet 10 with adhesive and pressure during the manufacturing process. This results in a laminated, multi-wall container especially suited for containing bulk materials, and such container has greater strength then that achievable by merely inserting the inner sleeve into the set-up body 60.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A corrugated paperboard container with locking bottom flaps that substantially self-maintains a squared-open configuration thereof, comprising:

a corrugated paperboard body formed by folding a corrugated paperboard sheet on a plurality of scores which define therein a sequence of a first panel, a second panel, a third panel, a fourth panel, and a manufacturer's joint, said manufacturer's joint overlapping a portion of the first panel and adhered thereto, said first panel, said second panel, said third panel, and said fourth panel defining side walls of said corrugated paperboard body;

each one of said first panel, said second panel, said third panel, and said fourth panel having at least a bottom flap foldably connected thereto along a respective score line;

said bottom flaps of at least said second panel and said fourth panel at least partially overlapping when said bottom flaps are folded on the respective scores to define a bottom for said corrugated paperboard body;

said bottom flap of said second panel defining a notch in a distal edge thereof intermediate said sides thereof; and said bottom flap of said fourth panel defining a wedge-shaped portion therein by a score extending at an oblique angle relative to a distal edge thereof from a side edge of said bottom flap to said distal edge intermediate said side edges thereof, and said intersection of said score defining said wedge-shaped portion and said distal edge for alignment with said notch in said bottom flap of said second panel, whereby said corrugated paperboard body, being squared-open, forms a bottom thereto by folding the bottom flaps one over the next in a sequence of said first panel, said second panel, said third panel, and said fourth panel, and maintains the squared-open configuration by engaging said distal edge portion of the bottom flap of the fourth panel in said notch in said distal edge of said bottom flap of said second panel by first foldingly moving the wedge-shaped portion on the score in a first direction to engage said distal edge and said notch and then moving said wedge-shaped portion in a second opposite direction past said bottom flap of said second panel, so that at least a portion of said wedge-shaped portion is covered by a portion of said bottom flap of the second panel.

2. The corrugated paperboard container as recited in claim 1, wherein said notch is medial said scores separating said second panel from said first panel and said third panel.

3. The corrugated paperboard container as recited in claim 1, wherein said notch defines a partial radius at an apex thereof.

4. A method of forming a bottom in a corrugated paperboard container in order that the container substantially self-maintains a squared-open configuration thereof, comprising the steps of:

(a) squaring-open a corrugated paperboard body formed by folding a corrugated paperboard sheet on a plurality of scores which define therein a sequence of a first panel, a second panel, a third panel, a fourth panel, and a manufacturer's joint, said manufacturer's joint overlapping a portion of the first panel and adhered thereto, said first panel, said second panel, said third panel, and said fourth panel defining side walls of said corrugated paperboard body;

(b) folding in sequence a first bottom flap, a second bottom flap, a third bottom flap, and a fourth bottom flap, said bottom flaps foldably connected along a score to said first panel, said second panel, said third panel, and said fourth panel, respectively;

said second and fourth bottom flaps at least partially overlapping at distal edge portions when said second and fourth bottom flaps are folded on the respective scores to define a bottom for said corrugated paperboard body;

(c) engaging a distal edge of said fourth bottom flap in a notch in a distal edge of said second bottom flap, said notch being intermediate said pair of scores separating said second panel from said first panel and said third panel, said engagement made by folding a wedge-shaped portion of said fourth panel in a first direction and moving said second bottom flap in said first direction, said wedge-shaped portion defined therein by a score extending at an oblique angle relative to a distal edge thereof from a side edge of said bottom flap to an inward edge thereof at said distal edge intermediate said score separating said fourth panel from said third panel and said side edge; and (d) insertingly moving said wedge-shaped portion in a second opposite direction past said second bottom flap of said second panel so that at least a portion of said wedge-shaped portion is overlapped by a portion of said second bottom flap, whereby said corrugated paperboard body, being squared-open, maintains the squared-open configuration by the engagement of said distal edge portion of the bottom flap of the fourth panel in said notch in said distal edge of said second panel.

* * * * *